US007178600B2

(12) United States Patent
Luke et al.

(10) Patent No.: US 7,178,600 B2
(45) Date of Patent: Feb. 20, 2007

(54) APPARATUS AND METHODS FOR UTILIZING A DOWNHOLE DEPLOYMENT VALVE

(75) Inventors: Mike A. Luke, Houston, TX (US); Tom Fuller, Insch (GB); Darrell Johnson, Katy, TX (US); David Brunnert, Cypress, TX (US); Brian Grayson, Sugar Land, TX (US); David Pavel, Kingwood, TX (US); R. K. Bansal, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 171 days.

(21) Appl. No.: 10/783,982

(22) Filed: Feb. 20, 2004

(65) Prior Publication Data

US 2004/0251032 A1 Dec. 16, 2004

Related U.S. Application Data

(63) Continuation-in-part of application No. 10/677,135, filed on Oct. 1, 2003, which is a continuation-in-part of application No. 10/288,229, filed on Nov. 5, 2002, and a continuation-in-part of application No. 10/676,376, filed on Oct. 1, 2003, which is a continuation-in-part of application No. 10/288,229, filed on Nov. 5, 2002.

(60) Provisional application No. 60/485,816, filed on Jul. 9, 2003.

(51) Int. Cl.
*E21B 34/10* (2006.01)

(52) U.S. Cl. ..... 166/373; 166/316; 166/319; 166/332.8; 166/375

(58) Field of Classification Search ..... 166/373–375, 166/316, 318, 319, 332.8, 334.2, 148, 193, 166/154, 325, 334.1, 386, 166; 251/64, 76, 251/339

See application file for complete search history.

(56) References Cited

U.S. PATENT DOCUMENTS 2,898,088 A * 8/1959 Alder ..... 367/83

(Continued)

FOREIGN PATENT DOCUMENTS

EP 0 945 590 A2 9/1999

(Continued)

OTHER PUBLICATIONS

U.K. Search Report, Application No. GB 0502884.0, dated Jun. 16, 2005.

(Continued)

*Primary Examiner*—Kenneth Thompson
(74) *Attorney, Agent, or Firm*—Patterson & Sheridan, LLP

(57) ABSTRACT

Methods and apparatus for utilizing a downhole deployment valve (DDV) to isolate a pressure in a portion of a bore are disclosed. Any combination of fail safe features may be used with or incorporated into the DDV such as redundant valve members, an upward opening flapper valve or a metering flapper below a sealing valve. In one aspect, a barrier or diverter located in the bore above a valve member of the DDV permits passage through the bore when the valve member is open and actuates when the valve member is closed. Once actuated, the barrier or diverter either stops or diverts any dropped objects prior to the dropped object reaching and potentially damaging the valve member. In another aspect, the tool string tripped in above the DDV includes an acceleration actuated brake that anchors the tool string to a surrounding tubular if the tool string is dropped.

15 Claims, 6 Drawing Sheets

U.S. PATENT DOCUMENTS 3,148,731 A * 9/1964 Holden ..... 166/141
3,831,138 A 8/1974 Rammner
3,986,350 A 10/1976 Schmidt
4,015,234 A 3/1977 Krebs
4,160,970 A 7/1979 Nicolson
4,276,931 A * 7/1981 Murray ..... 166/99
4,367,794 A * 1/1983 Bednar et al. ..... 166/66.5
4,440,231 A * 4/1984 Martin ..... 166/373
4,553,428 A 11/1985 Upchurch
4,691,203 A 9/1987 Rubin et al.
4,709,900 A * 12/1987 Dyhr ..... 251/5
4,775,009 A 10/1988 Wittrisch et al.
5,172,717 A 12/1992 Boyle et al.
5,235,285 A 8/1993 Clark et al.
5,293,551 A 3/1994 Perkins et al.
5,303,773 A 4/1994 Czernichow et al.
5,355,952 A 10/1994 Meynier
5,512,889 A 4/1996 Fletcher
5,730,219 A 3/1998 Tubel et al.
5,892,860 A 4/1999 Maron et al.
5,992,519 A 11/1999 Ramakrishnan et al.
5,996,687 A 12/1999 Pringle et al.
6,006,832 A 12/1999 Tubel et al.
6,018,501 A 1/2000 Smith et al.
6,072,567 A 6/2000 Sapack
6,075,462 A 6/2000 Smith
6,173,772 B1 1/2001 Vaynshteyn
6,176,312 B1 1/2001 Tubel et al.
6,191,586 B1 2/2001 Bittar
6,199,629 B1 3/2001 Shirk et al.
6,209,663 B1 4/2001 Hosie
6,283,207 B1 9/2001 Lemetayer
6,308,137 B1 10/2001 Underhill et al.
6,354,147 B1 3/2002 Gysling et al.
6,378,612 B1 * 4/2002 Churchill ..... 166/319
6,422,084 B1 7/2002 Fernald et al.
6,425,444 B1 7/2002 Metcalfe et al.
6,427,776 B1 8/2002 Hoffman et al.
6,478,091 B1 11/2002 Gano
6,585,041 B2 7/2003 Crossley
6,598,675 B2 7/2003 Bussear et al.
6,684,950 B2 2/2004 Patel
6,820,697 B1 * 11/2004 Churchill ..... 166/374
2003/0150621 A1 8/2003 Pia
2004/0065446 A1 4/2004 Tran et al.
2004/0139791 A1 7/2004 Johansen
2005/0230118 A1 * 10/2005 Noske et al. ..... 166/332.8

FOREIGN PATENT DOCUMENTS

GB 2 154 632 9/1985
GB 2 299 915 A 10/1996
GB 2 330 598 4/1999
GB 2 335 453 9/1999
GB 2 360 532 A 8/2000
GB 2 381 282 4/2003
GB 2 394 242 4/2004
GB 2 394 974 5/2004
GB 2 400 125 10/2004
GB 2 403 250 12/2004

OTHER PUBLICATIONS

Downhole Deployment Valve Bulletin, Weatherford International Ltd., (online) Jan. 2003. Available from http://www.weatherford.com/weatherford/groups/public/documents/general/wft004406.pdf.

Nimir Field In Oman Proves The Downhole Deployment Valve A Vital Technological key To Success, Weatherford International Ltd., (online) 2003. Available at http://www.weatherford.com/weatherford/groups/public/documents/general/wft004337.pdf.

* cited by examiner

APPARATUS AND METHODS FOR UTILIZING A DOWNHOLE DEPLOYMENT VALVE

CROSS-REFERENCE TO RELATED APPLICATIONS

This application is a continuation-in-part of co-pending U.S. patent application Ser. No. 10/677,135, filed Oct. 1, 2003, which is a continuation in part of U.S. patent application Ser. No. 10/288,229, filed Nov. 5, 2002, which are herein incorporated by reference in their entirety. This application is a continuation-in-part of co-pending U.S. patent application Ser. No. 10/676,376, filed Oct. 1, 2003, which is a continuation in part of U.S. patent application Ser. No. 10/288,229, filed Nov. 5, 2002, which are herein incorporated by reference in their entirety. This application claims benefit of U.S. Provisional Patent Application Ser. No. 60/485,816, filed Jul. 9, 2003, which is herein incorporated by reference in its entirety.

BACKGROUND OF THE INVENTION

1. Field of the Invention

Embodiments of the invention generally relate to methods and apparatus for use in oil and gas wellbores. More particularly, the invention relates to methods and apparatus for utilizing deployment valves in wellbores.

2. Description of the Related Art

Oil and gas wells typically begin by drilling a borehole in the earth to some predetermined depth adjacent a hydrocarbon-bearing formation. After the borehole is drilled to a certain depth, steel tubing or casing is typically inserted in the borehole to form a wellbore, and an annular area between the tubing and the earth is filed with cement. The tubing strengthens the borehole, and the cement helps to isolate areas of the wellbore during hydrocarbon production.

Wells drilled in an "overbalanced" condition with the wellbore filled with fluid or mud preventing the inflow of hydrocarbons until the well is completed provide a safe way to operate since the overbalanced condition prevents blow outs and keeps the well controlled. Overbalanced wells may still include a blow out preventer in case of a pressure surge. Disadvantages of operating in the overbalanced condition include expense of the mud and damage to formations if the column of mud becomes so heavy that the mud enters the formations. Therefore, underbalanced or near underbalanced drilling may be employed to avoid problems of overbalanced drilling and encourage the inflow of hydrocarbons into the wellbore. In underbalanced drilling, any wellbore fluid such as nitrogen gas is at a pressure lower than the natural pressure of formation fluids. Since underbalanced well conditions can cause a blow out, underbalanced wells must be drilled through some type of pressure device such as a rotating drilling head at the surface of the well. The drilling head permits a tubular drill string to be rotated and lowered therethrough while retaining a pressure seal around the drill string.

A downhole deployment valve (DDV) located within the casing and operated through a control line may be used to temporarily isolate a formation pressure below the DDV such that a tool string may be quickly and safely tripped into a portion of the wellbore above the DDV that is temporarily relieved to atmospheric pressure. An example of a DDV is described in U.S. Pat. No. 6,209,663, which is incorporated by reference herein in its entirety. Thus, the DDV allows the tool string to be tripped into the wellbore at a faster rate than snubbing the tool string in under pressure. Since the pressure above the DDV is relieved, the tool string can trip into the wellbore without wellbore pressure acting to push the tool string out. Further, the DDV permits insertion of a tool string into the wellbore that cannot otherwise be inserted due to the shape, diameter and/or length of the tool string.

An object accidentally dropped onto the DDV that is closed during tripping of the tool string presents a potential dangerous condition. The object may be a complete bottom hole assembly (BHA), a drill pipe, a tool, etc. that free falls through the wellbore from the location where the object was dropped until hitting the DDV. Thus, the object may damage the DDV due to the weight and speed of the object upon reaching the DDV, thereby permitting the stored energy of the pressure below the DDV to bypass the DDV and either eject the dropped object from the wellbore or create a dangerous pressure increase or blow out at the surface. A failsafe operation in the event of a dropped object may be required to account for a significant amount of energy due to the large energy that can be generated by, for example, a 25,000 pound BHA falling 10,000 feet in air.

Increasing safety when utilizing the DDV permits an increase in the amount of formation pressure that operators can safely isolate below the DDV. Further, increased safety when utilizing the DDV may be necessary to comply with industry requirements or regulations such as standards that require a double barrier or redundant seals between the isolated formation pressure below the DDV and operators at the surface.

Therefore, there exists a need for apparatus and methods that provide a fail safe operation when utilizing a DDV. There exists a further need for apparatus and methods that permit a DDV to maintain a closed position or at least a safe operating position in the event of a dropped object.

SUMMARY OF THE INVENTION

The invention generally relates to methods and apparatus for utilizing a downhole deployment valve (DDV) to isolate a pressure in a portion of a bore. Any combination of fail safe features may be used with or incorporated into the DDV such as redundant valve members, an upward opening flapper valve or a metering flapper below a sealing valve. In one aspect, a barrier or diverter located in the bore above a valve member of the DDV permits passage through the bore when the valve member is open and actuates when the valve member is closed. Once actuated, the barrier or diverter either stops or diverts any dropped objects prior to the dropped object reaching and potentially damaging the valve member. In another aspect, the tool string tripped in above the DDV includes an acceleration actuated brake that anchors the tool string to a surrounding tubular if the tool string is dropped.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally relates to methods and apparatus for utilizing a downhole deployment valve (DDV) in a wellbore. The DDV may be any type of valve such as a flapper valve or ball valve. Additionally, any type of actuation mechanism may be used to operate the DDV. For example, the DDV may actuate between an open and closed position by fluid pressure or electric current supplied from a control line.

Figure 1:
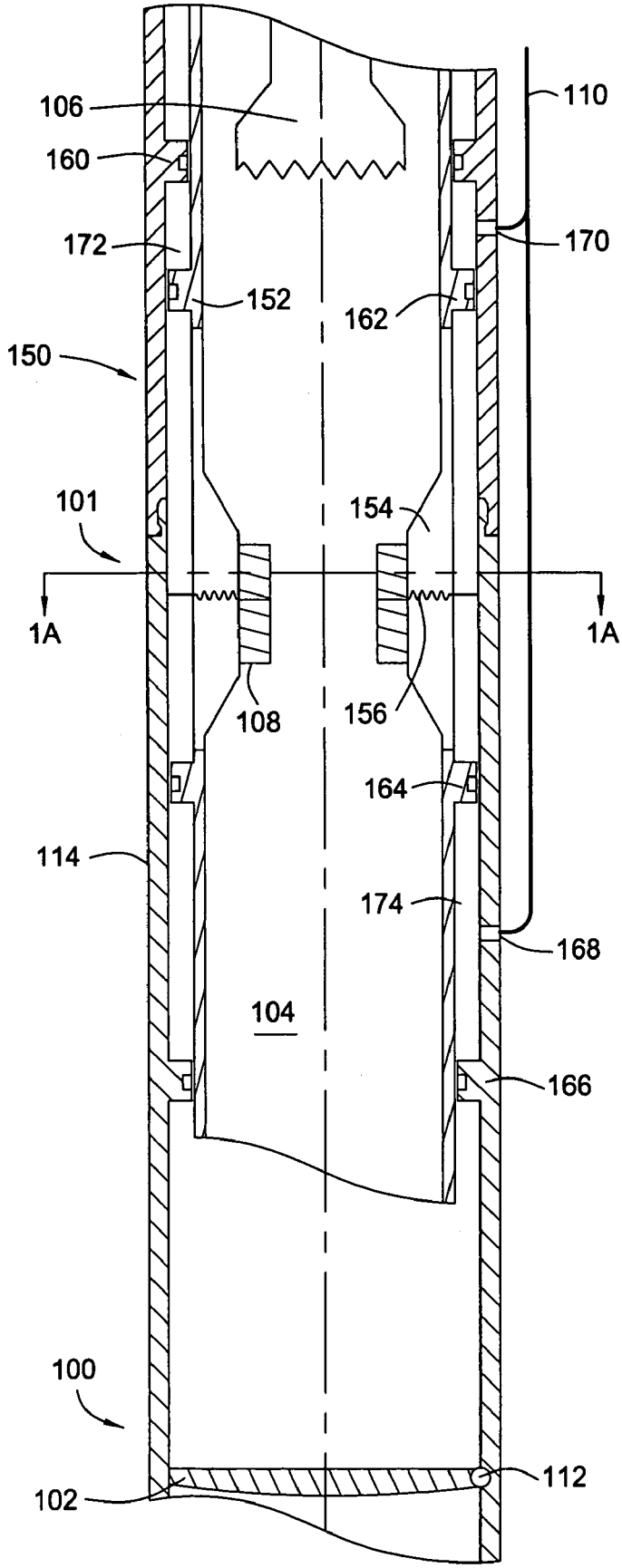
FIG. 1 is a section view of a downhole deployment valve (DDV) in a closed position with a barrier assembly in an extended position to stop an object prior to contacting a flapper of the DDV.

FIG. 1 illustrates a section view of a DDV 100 in a closed position with a barrier assembly 101 in an extended position. The barrier assembly 101 and the DDV 100 are disposed in casing, and the barrier assembly 101 may be an integral part of the DDV 100 or a separate component. As shown, a flapper 102 of the DDV 100 rotates about pivot 112 to seal a bore 104 passing through the DDV 100, thereby isolating the formation pressure below the flapper 102 from the bore 104 above the flapper 102. A tool string 106 is tripped into the bore 104 while the DDV 100 is in the closed position.

Figure 1A:
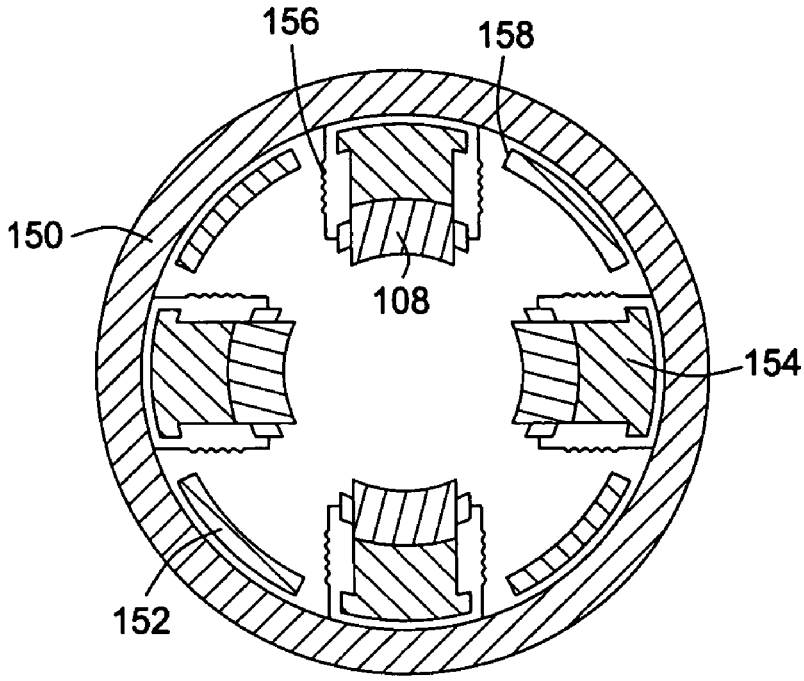
FIG. 1A is a cross section of the barrier assembly across line 1A—1A in FIG. 1.

The barrier assembly 101 includes an outer housing 150 that connects into casing, an inner mandrel 152 having a cone section 154 therein, and stop members 108 in contact with an inside of the mandrel 152 and biased outward toward the housing 150 by springs 156. As shown in FIG. 1A, the springs 156 attach to the housing 150, pass through slots 158 in the mandrel 152 and attach to the stop members 108. The mandrel 152 moves relative to the housing 150 by selectively applying fluid pressure through a hydraulic control line 110 to either an upper port 170 or a lower port 168. Since the stop members 108 do not move axially, the stop members 108 slide along the inside surface of the mandrel 152 during movement of the mandrel 152. In the extended position of the barrier assembly 101, fluid supplied to the lower port 168 enters a lower annular chamber 174 formed between a lower outward shoulder 164 on the mandrel 152 and a lower inward shoulder 166 on the housing 150. The fluid pressure acts on the lower outward shoulder 164 and moves the mandrel 152 up to place the mandrel 152 in an upper position. In the upper position of the mandrel 152, the stop members 108 are located adjacent the cone section 154 of the mandrel 152. Thus, the stop members 108 extend into the bore 104 since the stop members 108 are supported by a portion of the cone section 154 with a decreased inner diameter when the mandrel 152 is in the upper position.

In the extended position, the inside diameter of the bore 104 at the stop members 108 is less than the outside diameter of the tool string 106 or any other potentially dropped objects. Thus, the barrier assembly 101 prevents the tool string 106 from passing below the stop members 108 when the barrier assembly 101 is in the extended position. In the event that the tool string 106 is dropped, the stop members 108 stop downward movement of the tool string 106 and prevent the tool string 106 from contacting the flapper 102 and damaging the DDV 100 since the barrier assembly 101 is located above the DDV 100. The barrier assembly 101 is maintained in the extended position as long as the DDV 100 is in the closed position.

Figure 2:
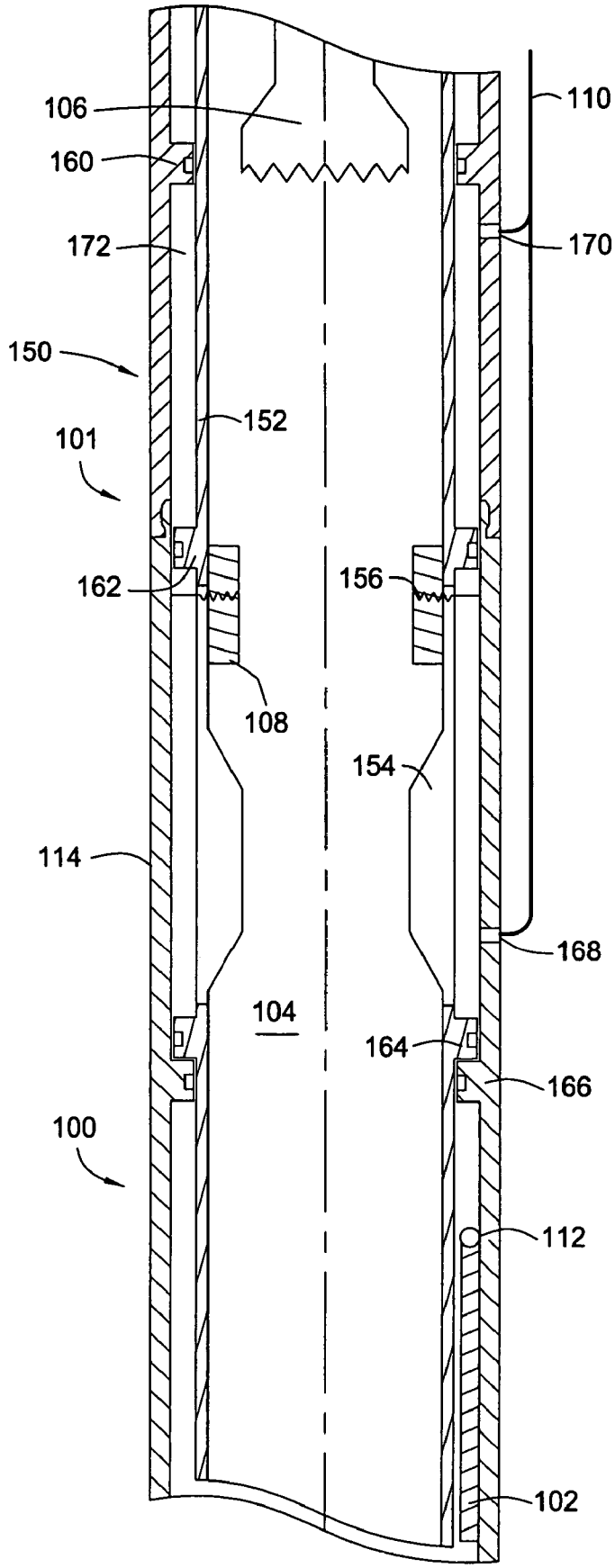
FIG. 2 is a section view of the DDV in FIG. 1 shown in an open position with the barrier assembly in a retracted position to permit passage therethrough.

FIG. 2 shows the DDV 100 in an open position and the barrier assembly 101 in a retracted position. In the retracted position of the barrier assembly 101, fluid supplied to the upper port 170 enters an upper annular chamber 172 formed between an upper outward shoulder 162 on the mandrel 152 and an upper inward shoulder 160 on the housing 150. In operation, the fluid pressure acts on the upper outward shoulder 162 and moves the mandrel 152 down to place the mandrel 152 in a down position. As the mandrel 152 moves from the up position to the down position, the stop members 108 slide off the cone section 154 and bias by the spring 156 against a portion of the mandrel 152 having a larger inner diameter than the cone section 154, thereby retracting the stop members 108.

In the retracted position, the inner diameter of the bore 104 at the stop members 108 is sufficiently larger than the outer diameter of the tool string 106 such that the tool string 106 can pass through the barrier assembly 101. Either the same actuator used to move the barrier assembly 101 between the extended and retracted positions or an independent actuator operated by the control line 110 may be used to actuate the DDV 100. For example, the mandrel 152 may extend down to the flapper 102 such that the downward movement of the mandrel 152 also displaces the flapper valve 102 of the DDV 100.

Figure 3A:
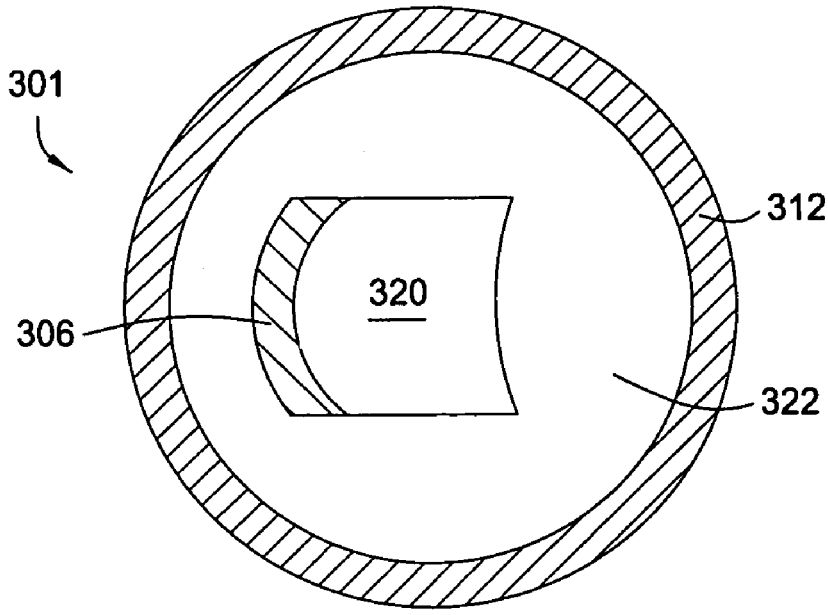
FIG. 3A is a cross section of the diverter across line 3A—3A in FIG. 3.
Figure 3:
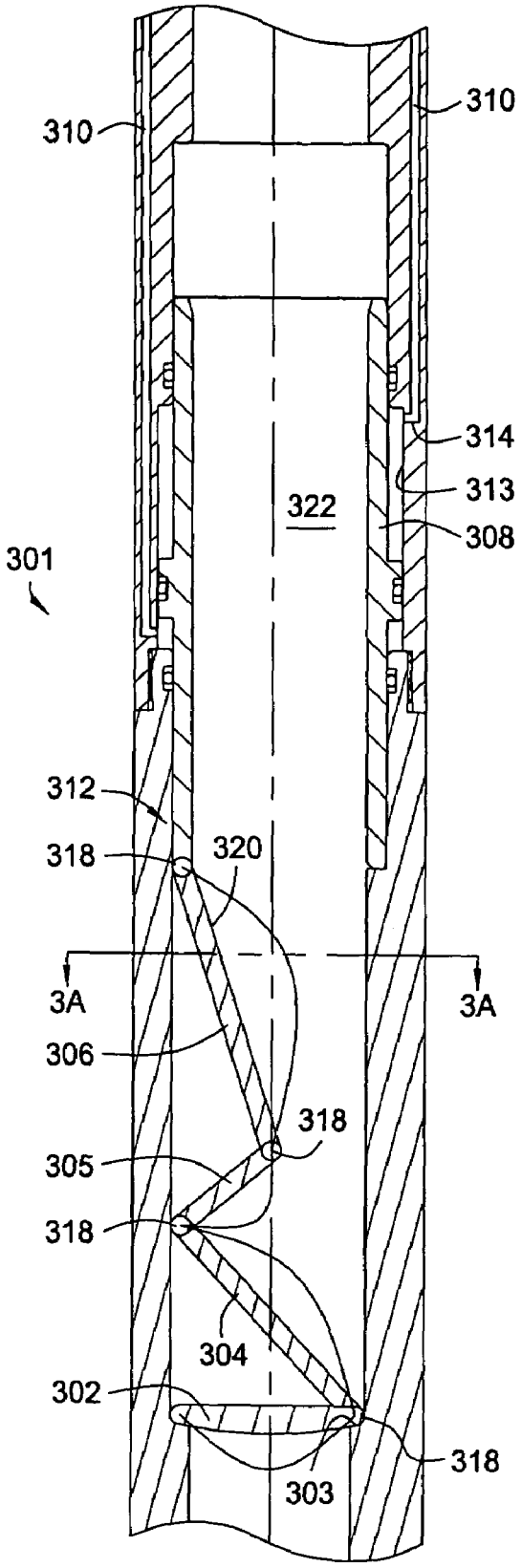
FIG. 3 is a section view of a diverter for use above a DDV and shown in a diverting position corresponding to a closed position of the DDV.

FIG. 3 illustrates a section view of a diverter 301 shown in a diverting position. Similar to the barrier assembly 101 shown in FIGS. 1 and 2, the diverter 301 is located above a DDV (not shown) to prevent any dropped objects capable of damaging the DDV from reaching the DDV. Thus, the diverter 301 is maintained in the diverting position as long as the DDV is closed.

The diverter 301 includes a housing 312, a flapper 302 hinged to the housing 312 and adjacent a seat 303 in the housing 312, a piston 308, and a lower, middle and upper diverter trough 304, 305, 306. Hinges 318 connect the upper diverter trough 306 to the piston 308, the diverter troughs 304, 305, 306 to each other, the lower diverter trough 304 to the flapper 302, and the flapper 302 to the housing 312. An increased inner diameter portion 313 of the housing 312 provides a piston cavity for the piston 308. Hydraulic lines 310 capable of selectively supplying fluid to opposite ends of the increased inner diameter portion 313 apply fluid pressures that act on the piston 308 accordingly to move the piston 308 relative to the housing 312. The hydraulic lines 310 may tie in with hydraulic lines used to actuate the DDV located below the diverter 301 such that the DDV and diverter 301 actuate together. While the hydraulic lines 310 are shown within the housing 312, the hydraulic lines 310 may be external to the housing 312. Fluid pressure from the lines 310 to a port 314 urges the piston 308 downward relative to the housing 312 and subsequently the diverter troughs 304, 305, 306 and flapper 302 which are all directly or indirectly connected to the piston 308. However, the flapper 302 can not move down relative to the housing 312 due to the hinge 318 between the flapper 302 and housing 312. Therefore, the flapper 302 rotates down onto the valve seat 303 and the diverter troughs 304, 305, 306 rotate in an accordion pattern to the diverting position as shown. Once seated in the valve seat 303, the flapper 302 receives loads from the diverter troughs 304, 305, 306. An inner concave surface 320 of the upper diverter trough 306 receives any dropped objects and diverts the dropped object toward the housing 312 since the upper diverter trough 306 in the diverting position is angled relative to the longitudinal axis of the housing 312. FIG. 3A illustrates the surface 320 of the upper diverter trough 306 located within a bore 322 through the diverter 301 when the diverter 301 is in the diverting position. The diverted object either wedges between the upper diverter trough 306 and the housing 312 and stops or is driven through the housing 312 into a surrounding formation. In either situation, the diverter 301 prevents damage to the DDV located below and avoids a dangerous well control situation since isolation of formation pressure is maintained by the DDV that is undamaged.

Figure 4:
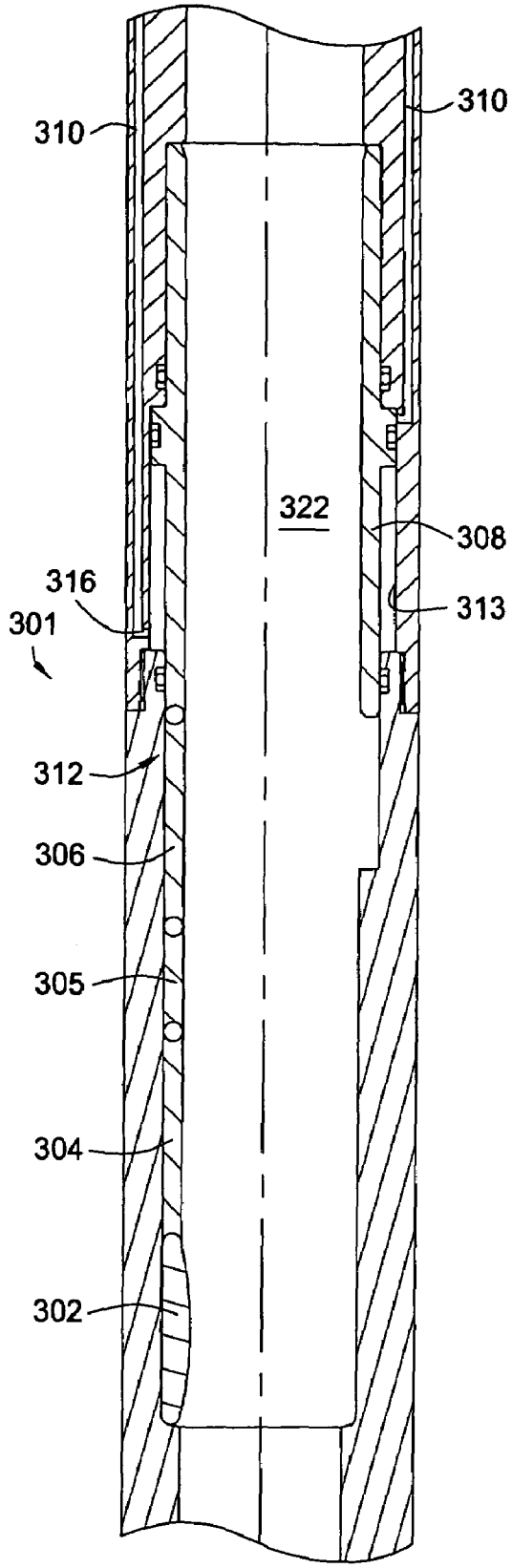
FIG. 4 is a section view of the diverter in FIG. 3 shown in an open position corresponding to an open position of the DDV.

FIG. 4 shows the diverter 301 in an open position corresponding to an open position of the DDV. Fluid pressure supplied from the lines 310 to a port 316 raises the piston 308 relative to the housing 312 in order to place the diverter 301 in the open position. However, any type of actuating mechanism may be used to move the diverter 301 between the diverted and open positions. In operation, the piston 308 pulls the upper diverter trough 306 and connected middle diverter trough 305, lower diverter trough 304 and flapper 302 upward relative to the housing 312. The upward movement causes the diverter troughs 304, 305, 306 and flapper 302 to move up against the wall of the housing 312 and into longitudinal alignment with the housing 312 to open the bore 322 through the diverter 301 and place the diverter 301 in the open position. Thus, the bore 322 through the diverter 301 is open when the DDV is open, thereby allowing passage of a tool string (not shown) through the diverter 301 and the DDV.

Figure 5:
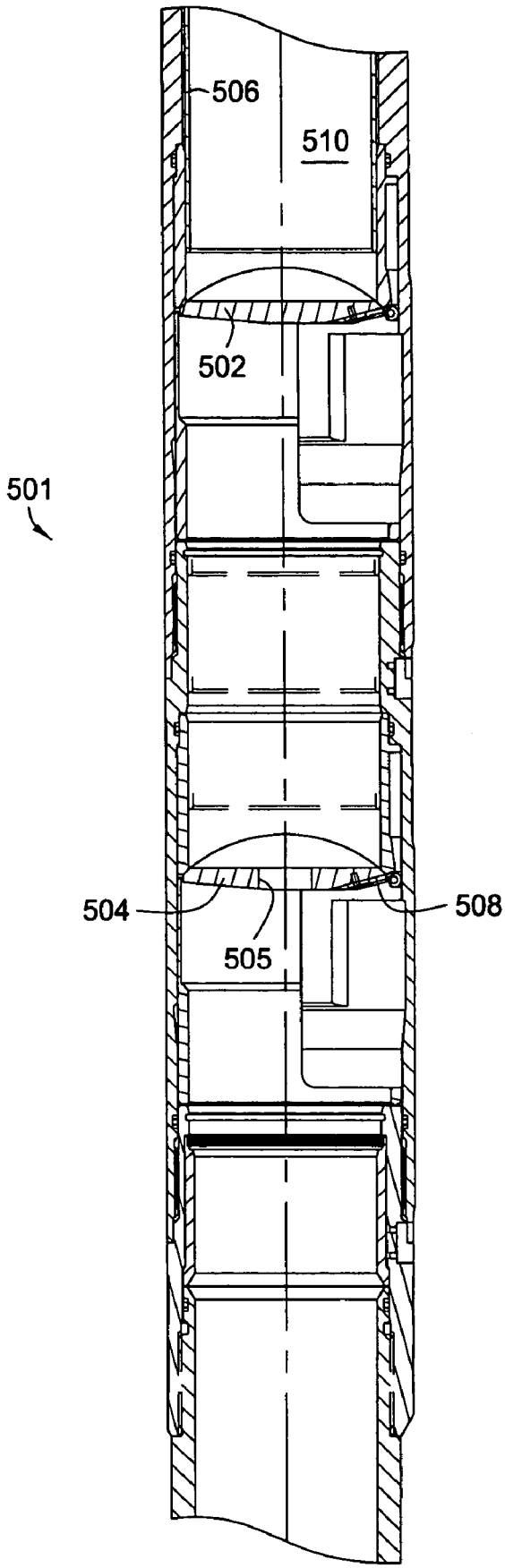
FIG. 5 is a section view of a DDV system utilizing multiple flappers.

FIG. 5 illustrates a section view of a DDV system 501 utilizing a first flapper 502 and a second flapper 504. An aperture 505 through the second flapper 504 permits fluid flow through the second flapper 504. Thus, the first flapper 502 provides the necessary seal in a bore 510 required to isolate formation pressure below the first flapper 502 when tripping in a tool string (not shown) above the DDV system 501. The aperture 505 through the second flapper 504 allows pressure above and below the second flapper 504 to equalize when both flappers 502, 504 are closed. Therefore, a biasing member 508 maintains the second flapper 504 closed without being aided by fluid pressure unlike the first flapper 502, which is acted on by fluid pressure to aid in maintaining the first flapper 502 closed.

The DDV system 501 having the first and second flappers 502, 504 provides a fail safe operation of the DDV system 501 in the event that an object (not shown) is dropped onto the DDV system 501. Depending on the energy of the dropped object, the first flapper 502 may stop the downward fall of the dropped object while sustaining damage that may prevent the first flapper 502 from sealing pressure from below. However, the aperture 505 in the second flapper 504 serves as a choke or metering flapper that prevents the flow rate from being large enough to eject the dropped object from the well or cause an unmanageable pressure increase at the surface. Alternatively, the first flapper 502 may not provide a sufficient counter force to stop the dropped object. Thus, the dropped object falls past the first flapper 502 and contacts the second flapper 504, which opens to permit the dropped object to pass through without significantly damaging the second flapper 504. The first flapper 502 may be damaged after being struck by the dropped object and may no longer isolate the bore 510 above the DDV system 501 from wellbore pressure. Once the dropped object passes through the second flapper 504, the second flapper 504 closes again to seal pressure from below while permitting a safe metered flow through the aperture 505. In operation, the second flapper 504 tends to open without sustaining substantial damage since the second flapper 504 is only held closed by the biasing force of the biasing member 508 plus the pressure drop across the second flapper 504, which is minor compared to the pressure across the first flapper 502 due to the aperture 505 through the second flapper 504 that permits pressure equalization above and below the second flapper 504.

In an alternative embodiment of the DDV system 501, the first flapper 502 or an additional flapper above the first flapper 502 is an upward opening flapper. Depending on whether the second flapper 504 includes the aperture 505, the second flapper 504 may seal pressure below or provide the choke as described above. The upward opening flapper is the first to be contacted by the dropped object and is capable of transferring downward forces from the dropped object to the seat of the upward opening flapper. Due to the upward opening flapper and its interaction with its seat, the upward opening flapper is capable of withstanding a greater load and stopping a greater force from a dropped object than a downward opening flapper.

As shown in FIG. 5, the first and second flappers 502, 504 are close in proximity to each other and are actuated in series using a single actuator mechanism (not shown) to longitudinally move a flow tube 506. The flow tube 506 moves downward to a first position in order to displace and open the first flapper 502. Continued downward movement of the flow tube 506 to a second position additionally displaces and opens the second flapper 504. By stopping the flow tube 506 at the first position with only the first flapper 502 open, tests based on the flow through the aperture 505 may be conducted to determine such characteristics as flow rate or production quality. Additionally, flow through the aperture 505 may permit limited production during certain completion operations.

In the alternative, the flappers 502, 504 may be separated by any distance and may be actuated in parallel such that all the flappers open simultaneously. For example, each flapper 502, 504 may be part of a separate DDV component of the DDV system 501 with each DDV component having its own actuation mechanism. A wellbore may be equipped with a DDV system 501 having any number of flappers or valve members associated with any number of DDV components. Additionally, the second flapper 504 or an additional flapper (not shown) may be a solid flapper like the first flapper 502 in order to provide redundant sealing of the DDV system 501 as may be desired. Using multiple flappers in a DDV system allows the DDV system to isolate higher pressures since the flappers may be used to incrementally hold pressure to a predefined specification by staging pressure across the flappers.

Figure 6:
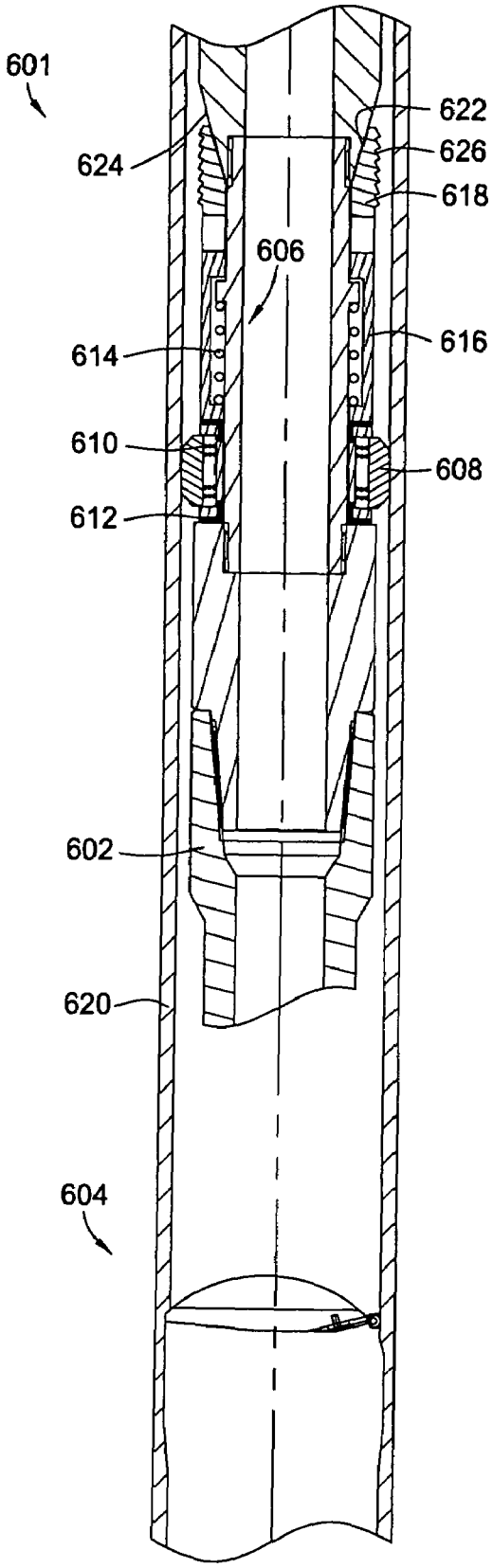
FIG. 6 is a section view of an acceleration actuated brake within a tool string shown in an unset position after tripping the tool string in above a closed DDV.

FIG. 6 illustrates a section view of an acceleration actuated brake 601 within a tool string 602 shown in an unset position after tripping the tool string 602 in above a closed DDV 604. The brake 601 includes an assembly of subs forming the main body 606 that connects into the tool string 602. The brake 601 preferably is disposed in the tool string 602 as close to the bottom of the tool string 602 as possible. Disposed about the main body 606 is a friction drag block 608 biased outward by a biasing member 610 and mounted in thrust and journal bearing assemblies 612, a slip retraction biasing member such as a spring 614, a spring housing 616, and an anchoring member such as slips 618. In operation, the drag block 608 biases against an inside surface of casing 620. The thrust and journal bearing assemblies 612 permit rotation of the drag block 608 with respect to the body 606 for drilling operations. Friction between the drag block 608 and the casing 620 creates a drag force during downward movement of the tool string 602. The spring 614 acts on an inward shoulder of the spring housing 616 and an outward shoulder of the body 606 to bias the spring housing 616 and the drag block 608 located adjacent a lower end of the spring housing 616 downward relative to the body 606 against the drag force that urges the drag block 608 and the spring housing 616 upward relative to the body 606. At normal downward velocities of the tool string 602 during tripping in of the tool string 602, the drag force is insufficient to overcome the bias of the spring 614 such that the spring housing 616 remains in a lower position and the slips 618 remain in the unset position. An internal conical surface 622 of the slips 618 contacts a mating external conical surface 624 of the body 606 along a minor end of the mating external conical surface 624 when the brake 601 is in the unset position.

Figure 7:
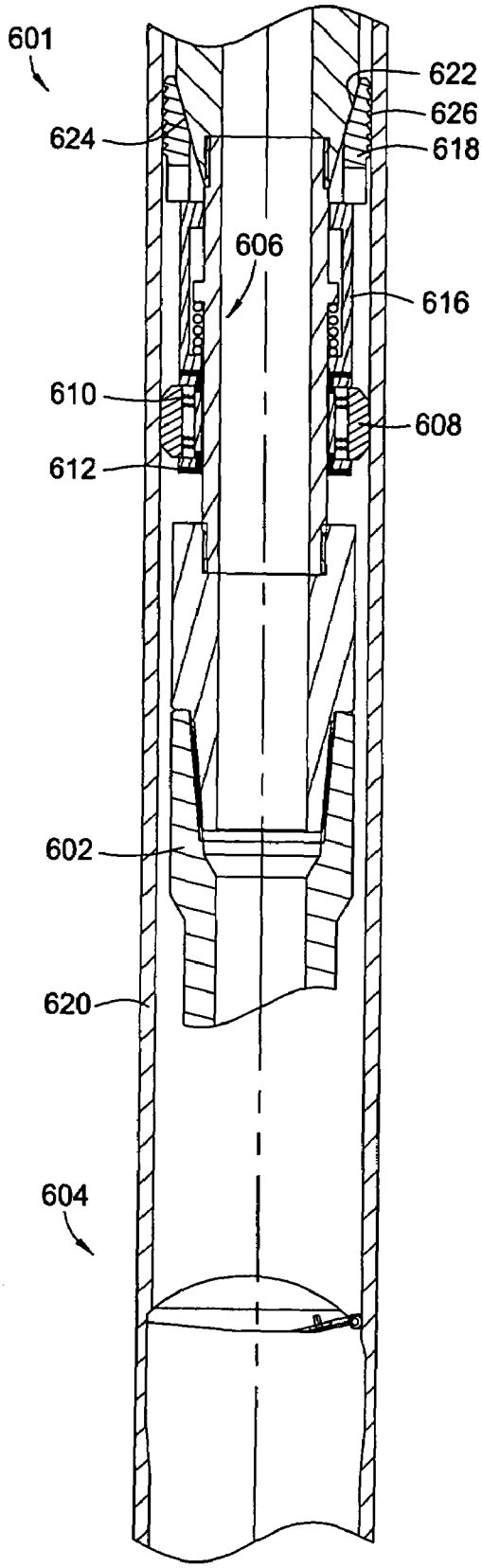
FIG. 7 is a section view of the acceleration actuated brake in FIG. 6 shown in a set position after dropping the tool string above the closed DDV.

FIG. 7 shows the brake 601 in a set position after dropping the tool string 602 above the closed DDV 604. As downward velocity of the tool string 602 increases once the tool string 602 is dropped, the drag force caused by the friction between the drag block 608 and the casing 620 increases. Thus, the increased drag force at a predetermined level overcomes the bias of the spring 614 to compress the spring 614 as the drag block 608 pushes the spring housing 616 upward relative to the body 606. A top end of the spring housing 616 acts on the slips 618 to slide the internal conical surface 622 of the slips 618 along the mating external conical surface 624 of the body 606. Movement of the slips 618 toward a major end of the mating external conical surface 624 causes the slips 618 to move outward in a radial direction. Thus, the slips 618 contact the inside of the casing 620 in the set position of the brake 601 and prevent movement of the tool string 602 through the casing 620. An outside surface of the slips 618 may have formations such as case hardened pointed wickers 626 that penetrate the inside surface of the casing 620 in order to further anchor the tool string 602 relative to the casing 620. The slips 618 can be fully retracted so that the brake 601 may be used again by picking up the tool string 602, which forces the slips 618 toward the minor end of the external conical surface 624.

In an alternative embodiment of the brake 601, an electronic module (not shown) replaces the drag block 608 and includes an accelerometer to detect the velocity of the brake 601. The electronic module may be powered by a battery carried on the brake 601. Thus, a signal from the accelerometer indicating that the tool string is free falling operates to set an anchoring member against the casing.

A shock attenuating material such as sand, fluid, water, foam or polystyrene balls may be placed above the DDV in combination with any aspect of the invention. For example, placing a water or fluid column above the DDV cushions the impact of the dropped object.

While the foregoing is directed to embodiments of the present invention, other and further embodiments of the invention may be devised without departing from the basic scope thereof, and the scope thereof is determined by the claims that follow.

The invention claimed is:

1. A downhole deployment valve (DDV) system, comprising:

a tubular string within a wellbore, the tubular string having a valve member for selectively obstructing a flow path through a bore of the tubular string; and an object stopping assembly for stopping an object falling toward the valve member prior to the object contacting the valve member, the object stopping assembly selectively movable between a first position where the bore proximate the object stopping assembly has an inside diameter and a second position where the bore proximate the object stopping assembly has a smaller inside diameter.

2. The DDV system of claim 1, wherein the assembly comprises at least one stop member selectively movable to at least partially obstruct the bore.

3. The DDV system of claim 1, wherein the assembly comprises a diverter disposed above the valve member, the diverter movable between an open position and a diverting position.

4. The DDV system of claim 1, wherein the assembly comprises an upward opening flapper member.

5. The DDV system of claim 1, further comprising an actuator member that actuates both the valve member and the assembly.

6. The DDV system of claim 1, further comprising a control line that substantially simultaneously supplies fluid pressure to an actuator for the valve member and an actuator for the assembly.

7. The DDV system of claim 1, further comprising a shock attenuating material above the valve member.

8. A downhole deployment valve (DDV) system, comprising:

a valve member for selectively obstructing a flow path through a bore of a tubular string;

a barrier member disposed at a location above the valve member, the barrier member selectively movable between a retracted position and an extended position to impede an object falling toward the valve member prior to the object contacting the valve member; and a biasing member operatively attached to the barrier member.

9. The system of claim 8, wherein the barrier member is biased in the retracted position by the biasing member.

10. The system of claim 8, wherein the barrier member is movable in response to movement of a mandrel having a cone member.

11. A method of using a downhole deployment valve (DDV) in a wellbore, comprising:

positioning an object stopping assembly at a location above the downhole deployment valve;

dropping an object in the wellbore; and actuating the object stopping assembly, thereby slowing the rate of decent of the object as it approaches a closed downhole deployment valve by using the object stopping assembly.

12. The method of claim 11, wherein the downhole deployment valve is closed and the object stopping assembly is actuated substantially simultaneously.

13. The method of claim 11, wherein the object stopping assembly is a barrier.

14. A method of using a downhole deployment valve (DDV) in a wellbore, comprising:

positioning an object stopping assembly at a location above the downhole deployment valve;

dropping an object in the wellbore; and slowing the rate of decent of the object as it approaches a closed downhole deployment valve by using the object stopping assembly, wherein the downhole deployment valve is closed and the object stopping assembly is actuated by fluid pressure supplied to a control line common to the valve member and the object stopping assembly.

15. A method of using a downhole deployment valve (DDV) in a wellbore, comprising:

positioning an object stopping assembly at a location above the downhole deployment valve;

dropping an object in the wellbore;

moving the object stopping assembly from a retracted position to an extended position; and slowing the rate of decent of the object as it approaches a closed downhole deployment valve by using the object stopping assembly.

* * * * *